US009469313B2

(12) United States Patent
Hagio et al.

(10) Patent No.: US 9,469,313 B2
(45) Date of Patent: Oct. 18, 2016

(54) BOGIE FRAME FOR RAILWAY VEHICLES

(71) Applicant: NIPPON STEEL & SUMITOMO METAL CORPORATION, Tokyo (JP)

(72) Inventors: Yoshinori Hagio, Tokyo (JP); Masanori Sawada, Tokyo (JP); Satoshi Tokunaga, Tokyo (JP); Kazuhiko Futagawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/400,845

(22) PCT Filed: Apr. 30, 2013

(86) PCT No.: PCT/JP2013/002880

§ 371 (c)(1),
(2) Date: Nov. 13, 2014

(87) PCT Pub. No.: WO2013/175716

PCT Pub. Date: Nov. 28, 2013

(65) Prior Publication Data

US 2015/0151768 A1 Jun. 4, 2015

(30) Foreign Application Priority Data

May 21, 2012 (JP) ..... 2012-115194

(51) Int. Cl.
*B61F 5/00* (2006.01)
*B61F 5/52* (2006.01)

(52) U.S. Cl.
CPC ..... *B61F 5/52* (2013.01)

(58) Field of Classification Search
CPC ..... B61F 5/52; B23K 9/00
USPC ..... 105/197–205
See application file for complete search history.

(56) References Cited

U.S. PATENT DOCUMENTS 2,098,459 A * 11/1937 McWhirter ..... B61F 3/04 105/167
3,948,188 A * 4/1976 Zehnder ..... B60G 11/04 105/167
4,173,933 A * 11/1979 Kayserling ..... B61F 5/148 105/182.1
4,175,772 A * 11/1979 Lampert ..... B60G 17/023 267/262

(Continued)

FOREIGN PATENT DOCUMENTS

CN 201901149 7/2011
EP 1 415 882 5/2004

(Continued)

*Primary Examiner* — Jason C Smith
(74) *Attorney, Agent, or Firm* — Clark & Brody

(57) ABSTRACT

A bogie frame for railway vehicles includes a pair of left and right side frames disposed along a direction of rails and a cross frame that connects the side frames to each other, and the cross frame includes a top plate member, a bottom plate member, and a pair of front and rear side plate members that are disposed between these plate members and welded thereto, wherein the cross frame has mounting bracket support portions that extend from front and rear edges of the top plate member and the bottom plate member, correspondingly to locations where mounting brackets for mounting a traction motor and mounting brackets for mounting a gearbox are disposed, and the mounting brackets are welded to the mounting bracket support portions. This makes it possible to achieve good welding workability for assembling the bogie frame.

7 Claims, 4 Drawing Sheets

(56) References Cited

U.S. PATENT DOCUMENTS 4,242,966 A * 1/1981 Holt ..... B61F 5/04 105/182.1
4,332,201 A * 6/1982 Pollard ..... B61F 3/04 105/167
4,363,277 A * 12/1982 Martin ..... B61F 5/22 105/164
4,648,326 A * 3/1987 Jackson ..... B61F 3/04 105/138
4,742,779 A * 5/1988 Bevand ..... B61F 3/04 105/167
5,020,824 A * 6/1991 Mounier-Poulat ..... B60G 5/053 267/266
5,039,071 A * 8/1991 Irle ..... B61F 5/148 105/197.05
5,632,208 A * 5/1997 Weber ..... B61F 3/10 105/182.1
6,119,602 A * 9/2000 Yoshino ..... B61F 5/305 105/167
6,250,232 B1 * 6/2001 Hachmann ..... B61F 5/325 105/157.1
6,338,300 B1 * 1/2002 Landrot ..... B61F 5/305 105/182.1
7,934,458 B2 * 5/2011 Gedenk ..... B61F 5/307 105/197.05
8,640,630 B2 * 2/2014 Gilmartin ..... B61F 5/24 105/199.2
8,813,654 B2 * 8/2014 Muller ..... B61F 5/52 105/172
2005/0116436 A1 * 6/2005 Landrot ..... B61F 5/305 280/124.109
2008/0229968 A1 * 9/2008 Gedenk ..... B61F 5/305 105/198.7
2010/0107923 A1 * 5/2010 Rodet ..... B61F 5/325 105/197.05
2011/0247520 A1 * 10/2011 Liu ..... B61F 3/02 105/197.05
2014/0123870 A1 * 5/2014 Nishimura ..... B61F 5/302 105/197.05
2015/0000553 A1 * 1/2015 Kimura ..... B61F 5/30 105/197.05
2015/0020708 A1 * 1/2015 Nishimura ..... B61F 5/302 105/197.05
2015/0083019 A1 * 3/2015 Nishimura ..... B61F 5/32 105/197.05
2015/0107487 A1 * 4/2015 Zanutti ..... B61F 5/325 105/172
2015/0151768 A1 * 6/2015 Hagio ..... B61C 9/50 105/202
2015/0158506 A1 * 6/2015 Nishimura ..... B61F 5/52 105/197.05
2015/0203132 A1 * 7/2015 Yoshizu ..... B61F 5/52 105/206.2
2015/0251670 A1 * 9/2015 Kamura ..... B61F 5/305 105/197.05

FOREIGN PATENT DOCUMENTS

JP 11-227602 8/1999
JP 2004-148948 5/2004
JP 3873659 1/2007
JP 4292980 7/2009
JP 2012-046069 3/2012

* cited by examiner (a)

(b)

BOGIE FRAME FOR RAILWAY VEHICLES

TECHNICAL FIELD

The present invention relates to a bogie frame for railway vehicles.

BACKGROUND ART

Railway vehicles are provided with traction motors and gearboxes mounted on their bogie frames, and they run on rails on power transmitted from the traction motors to wheel sets through the gearboxes.

FIG. 1 is a plan view of a conventional bogie frame. FIG. 2 is an enlarged plan view showing a region where a mounting bracket is located in a cross frame of the conventional bogie frame. As shown in FIG. 1, the bogie frame 101 includes a pair of left and right side frames 102 disposed along a direction of rails and cross frames 103 that connect the side frames 102 to each other. The cross frames 103 are each composed of a cylindrical steel pipe, and are welded at both ends to the side frames 102.

A mounting bracket 104 for mounting a traction motor (hereinafter also referred to as "mounting bracket 104 for a traction motor") is welded to each cross frame 103 at its outer peripheral surface, and further a mounting bracket 105 for mounting a gearbox (hereinafter also referred to as "mounting bracket 105 for a gearbox") is welded to each cross frame 103 at its outer peripheral surface (see, for example, Patent Literatures 1 and 2).

It is to be noted that the mounting bracket 104 for a traction motor and the mounting bracket 105 for a gearbox are components that are totally independent and separate from the cross frame 103 before being joined thereto. The mounting bracket 104 for a traction motor is formed with a rib structure in many cases because it is subjected to a heavy load such as the reaction force of power from the traction motor and the weight of the traction motor itself during travel of the railway vehicle. The same applies to the mounting bracket 105 for a gearbox. As a result, the conventional bogie frame 101 has many weld zones having short weld lines because the rib-structured mounting brackets 104 and 105 are welded to the cylindrical cross frames 103. In a weld zone, weld quality tends to deteriorate at start and end points of the weld, and thus zones having short weld lines are more likely to have this tendency.

Furthermore, stress concentration is more likely to occur in the weld zones between the mounting brackets 104 and 105 and the cross frame 103 because of the heavy load applied to the mounting brackets 104 and 105 during travel of the railway vehicle. In particular, as shown in FIG. 2, at the base end regions of the upper surface portions and the lower surface portions of the mounting brackets 104 and 105 that are joined to the cross frame 103 (the regions indicated by bold line circles in FIG. 2), there exist toes of fillet welds which are referred to as "fillet weld toes", and stresses are concentrated at the fillet weld toes. Because of this, it is essential that the fillet weld toes be treated for smoothing with a grinder or the like.

Bogie frames are required to have good welding workability for assembling because the work of assembling mostly involves welding. However, as described above, the conventional bogie frame 101 is provided with many weld zones having short weld lines and in addition with fillet weld toes that are required to be treated, when the mounting brackets 104 for a traction motor and the mounting brackets 105 for a gearbox are welded to the cross frames 103. Thus, the conventional bogie frame 101 is more likely to suffer deterioration of the weld quality at the weld zones, and has low efficiency for the work of welding. Therefore, the conventional bogie frame 101 is provided with poor welding workability for assembling.

CITATION LIST

Patent Literature

Patent Literature 1: Japanese Patent No. 4292980
Patent Literature 2: Japanese Patent No. 3873659

SUMMARY OF INVENTION

Technical Problem

The present invention has been made in view of the foregoing problems. Accordingly, it is an object of the present invention to provide a bogie frame for railway vehicles in which good welding workability for assembling is achieved.

Solution to Problem

In order to achieve the above object, the present inventors set their goal on improving the efficiency of the work of welding while ensuring the quality of weld zones when welding mounting brackets for a traction motor and mounting brackets for a gearbox to a cross frame, and they conducted intensive studies on techniques capable of reducing weld zones having short weld lines and also reducing fillet weld toes that need to be treated. Consequently, they have found that it is advantageous to construct a cross frame with four plates joined together (joined-four-plate structure), and further, to provide a top plate member and a bottom plate member, among all the plate members which constitute the four planes, with mounting bracket support portions integrally formed therewith so that the mounting bracket support portions serve as an upper surface portion and a lower surface portion of a mounting bracket for a traction motor and as those of a mounting bracket for a gearbox, and to weld the mounting brackets to such mounting bracket support portions.

The present invention has been accomplished based on this finding, and the summaries thereof are set forth below as to the bogie frame for railway vehicles. Specifically, there is provided a bogie frame for railway vehicles, comprising: a pair of left and right side frames disposed along a direction of rails and a cross frame that connects the side frames to each other, the cross frame comprising a top plate member, a bottom plate member, and a pair of front and rear side plate members that are disposed between the top plate member and the bottom plate member and welded thereto, wherein the cross frame has mounting bracket support portions that extend from front and rear edges of the top plate member and the bottom plate member, the mounting bracket support portions being located correspondingly to locations where mounting brackets for mounting a traction motor and mounting brackets for mounting a gearbox are disposed, and the mounting brackets are welded to the mounting bracket support portions.

Furthermore, in the above-mentioned bogie frame, it is preferred that the cross frame has a contoured shape such that a flared portion which is bent at least three points is provided between each of the left and right edges of the mounting bracket support portions and a corresponding one of the front and rear edges of the top plate member and the bottom plate member.

In the above-mentioned bogie frame, it is preferred that the side frame comprises a side frame top plate member, a side frame bottom plate member, and a pair of left and right side frame side plate members that are disposed between the side frame top plate member and the side frame bottom plate member and welded thereto, and that each of the side frames has a connecting portion that extends from one of left and right edges of the side frame top plate member thereof and a corresponding connecting portion that extends from a corresponding edge of the side frame bottom plate member thereof, the connecting portions being located correspondingly to a location where the cross frame is disposed, and that left and right end portions of the cross frame are fitted between the connecting portions and welded thereto.

Advantageous Effects of Invention

The bogie frame for railway vehicles of the present invention is capable of being provided with reduced weld zones having short weld lines and also with reduced fillet weld toes that need to be treated when mounting brackets for a traction motor and mounting brackets for a gearbox are welded to the cross frame. As a result, it is possible to improve the efficiency of the work of welding while ensuring the quality of the weld zones, thus making it possible to achieve good welding workability for assembling.

DESCRIPTION OF EMBODIMENTS

Hereinafter, embodiments of the bogie frame for railway vehicles of the present invention are described in detail.

Figure 3:
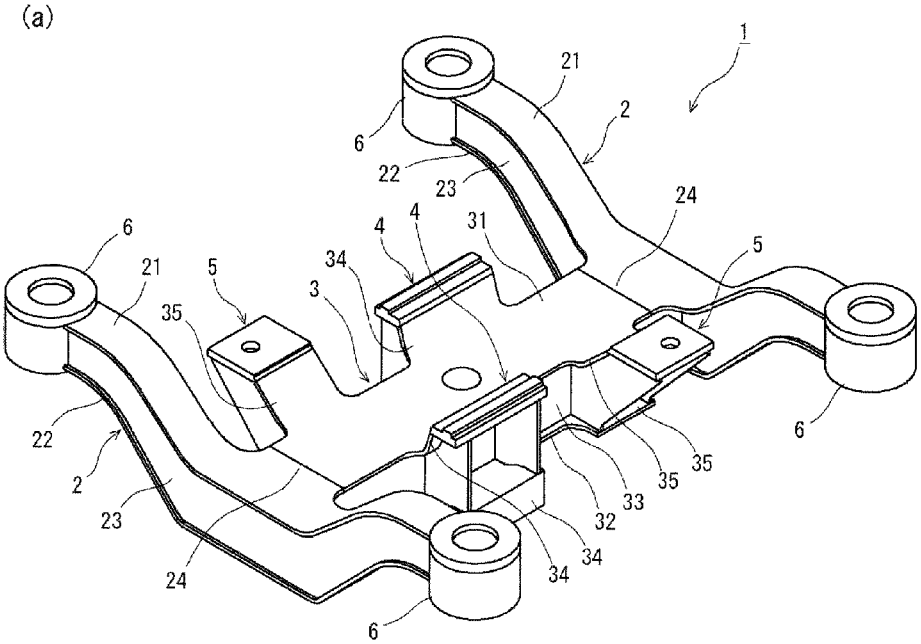
FIG. 3 shows perspective views of an example of a bogie frame according to the present invention, wherein FIG. 3(*a*) is a perspective view thereof from above and FIG. 3(*b*) is a perspective view thereof from below.
Figure 3:
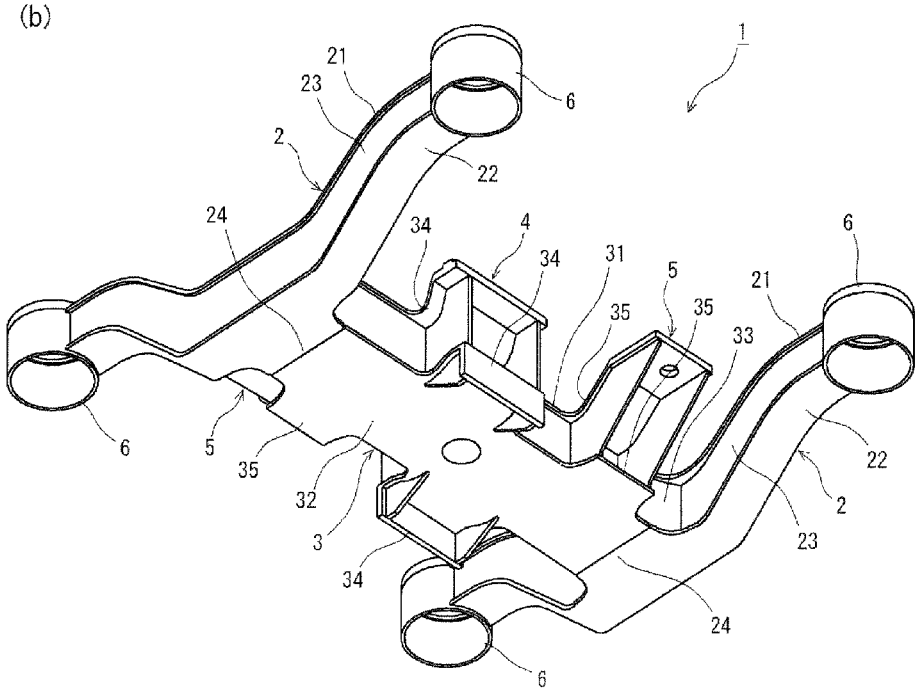
Figure 4:
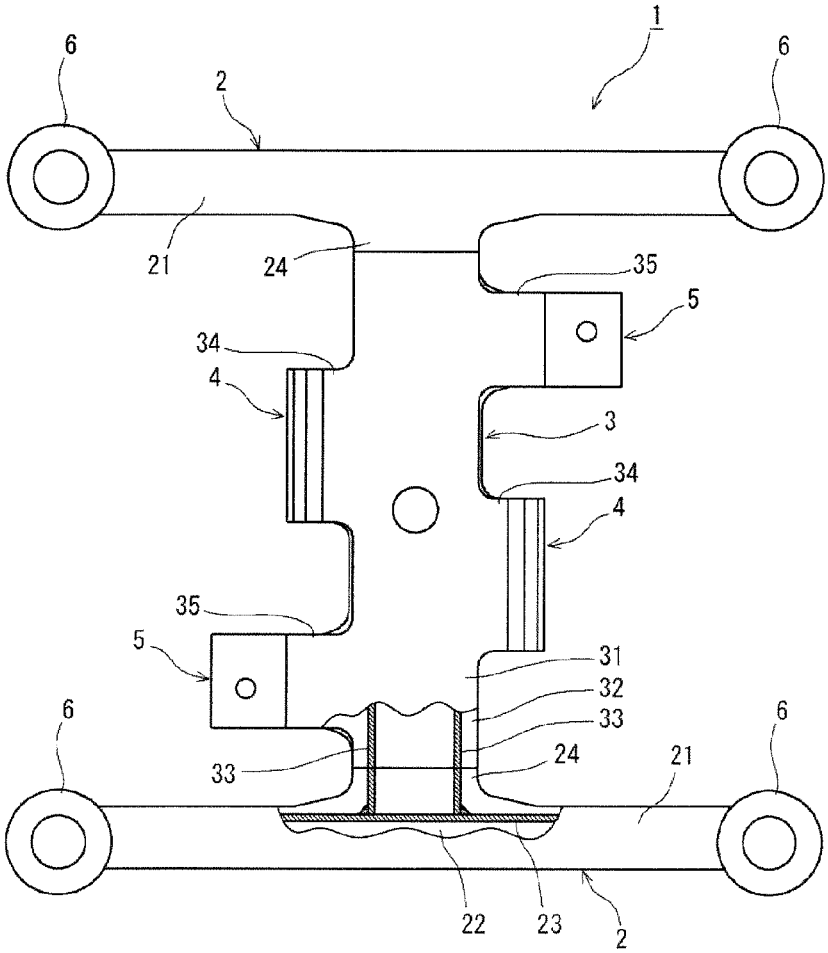
FIG. 4 is a plan view of the bogie frame shown in FIG. 3.

FIG. 3 shows perspective views of an example of a bogie frame according to the present invention, wherein FIG. 3(*a*) is a perspective view thereof from above and FIG. 3(*b*) is a perspective view thereof from below. FIG. 4 is a plan view of the bogie frame shown in FIG. 3. FIG. 4 is a partial cutaway view, showing a region where the cross frame and the side frames are connected to each other. As shown in FIGS. 3 and 4, the bogie frame 1 includes a pair of left and right side frames 2 disposed along a direction of rails and a cross frame 3 that connects the side frames 2 to each other. In the bogie frame 1 of the present invention, the cross frame 3 has a joined-four-plate structure, and the side frames also have a joined-four-plate structure.

Specifically, the cross frame 3 is composed of a top plate member 31 (hereinafter also referred to as "cross frame top plate member 31"), a bottom plate member 32 (hereinafter also referred to as "cross frame bottom plate member 32"), and a pair of front and rear side plate members 33 (hereinafter also referred to as "cross frame side plate members 33"). These plate members 31 to 33 are formed by stamping a steel plate and as necessary applying a bending process. The cross frame side plate members 33 are disposed between the cross frame top plate member 31 and the cross frame bottom plate member 32, and the top edges of the cross frame side plate members 33 are abutted against the lower surface of the cross frame top plate member 31 and joined thereto by welding, and the bottom edges of the cross frame side plate members 33 are abutted against the upper surface of the cross frame bottom plate member 32 and joined thereto by welding. In this manner, the cross frame 3 is assembled. Mounting brackets 4 for a traction motor and mounting brackets 5 for a gearbox, each having a rib structure, are welded to the cross frame 3.

The paired left and right side frames 2 are each composed of a side frame top plate member 21, a side frame bottom plate member 22, and a pair of left and right side frame side plate members 23. These plate members 21 to 23 are also formed by stamping a steel plate and as necessary applying a bending process. The side frame side plate members 23 are each disposed between the side frame top plate member 21 and the side frame bottom plate member 22, and the top edges of the side frame side plate members 23 are abutted against the lower surface of the side frame top plate member 21 and joined thereto by welding, and the bottom edges of the side frame side plate members 23 are abutted against the upper surface of the side frame bottom plate member 22 and joined thereto by welding. In this manner, the side frame 2 is assembled.

At the front and rear ends of the side frames 2, there are provided spring cover members 6 welded thereto. The spring cover members 6 are used for mounting of axle boxes (not shown) that rotatably support wheel sets.

The cross frame 3 connects the side frames 2 to each other via its left and right end portions to which the side frames 2 are welded. The portions that connect the cross frame 3 and the side frames 2 are configured in the following manner. Each side frame 2 has a connecting portion 24 that extends from one of left and right edges of the side frame top plate member 21 and a corresponding connecting portion 24 that extends from a corresponding edge of the side frame bottom plate member 22, in such a manner that the connecting portions are located correspondingly to the location where the cross frame 3 is disposed. These connecting portions 24 are integrally formed with the respective side frame top plate members 21 and side frame bottom plate members 22. In the meantime, the cross frame 3 has a configuration such that the cross frame top plate member 31 and the cross frame bottom plate member 32 are shorter than the cross frame side plate members 33, and the left and right end portions of the cross frame side plate members 33 protrude relative to the cross frame top plate member 31 and the cross frame bottom plate member 32.

The end portions of the cross frame side plate members 33 are fitted between their corresponding connecting portions 24, and in this state, the end edges of the cross frame side plate members 33 are abutted against the side frame side plate members 23 and joined thereto by welding, and the top edges thereof are abutted against the lower surface of the cross frame top plate member 31 and joined thereto by welding, and the bottom edges thereof are abutted against the upper surface of the cross frame bottom plate member 32 and joined thereto by welding. Furthermore, the end edges of the cross frame top plate member 31 and the cross frame bottom plate member 32 are abutted against the end edges of the connecting portions 24 of the side frames 2 in such a manner that they are flush with each other, and welded to each other. In this manner, the side frames 2 are connected to each other via the cross frame 3.

When the cross frame 3 and the side frames 2 are connected at the connecting portions 24 that extend from the side frames 2 as described above, the welded junctions between the cross frame 3 and the side frames 2 in the top and bottom planes are positioned on the cross frame 3. Thus, high stress caused by the load applied to the bogie frame 1 can be borne safely at both end portions of the cross frame 3 having a stable strength level.

As described above, the bogie frame 1 of the present invention has such a configuration that the cross frame 3 is constructed with a joined-four-plate structure, and further, it is configured as described below for the welding of the mounting brackets 4 for a traction motor and the mounting brackets 5 for a gearbox to the cross frame 3. The cross frame top plate member 31 and the cross frame bottom plate member 32 each have mounting bracket support portions 34 (hereinafter also referred to as "mounting bracket for a traction motor support portions 34") that extend from their front and rear edges, correspondingly to locations where the mounting brackets 4 for a traction motor are disposed. These mounting bracket support portions 34 serve as the upper surface portions and the lower surface portions of the mounting brackets 4 for a traction motor, and they are integrally formed with the cross frame top plate member 31 and the cross frame bottom plate member 32.

Furthermore, the cross frame top plate member 31 and the cross frame bottom plate member 32 each have mounting bracket support portions 35 (hereinafter also referred to as "mounting bracket for a gearbox support portions 35") that extend from their front and rear edges, correspondingly to locations where the mounting brackets 5 for a gearbox are disposed. These mounting bracket support portions 35 serve as the upper surface portions and the lower surface portions of the mounting brackets 5 for a gearbox, and the mounting bracket support portions 35 are integrally formed with the cross frame top plate member 31 and the cross frame bottom plate member 32. The mounting brackets 4 for a traction motor and the mounting brackets 5 for a gearbox, each having a rib structure, are welded to their respective mounting bracket support portions 34 and 35 and further to the cross frame side plate members 33.

Figure 2:
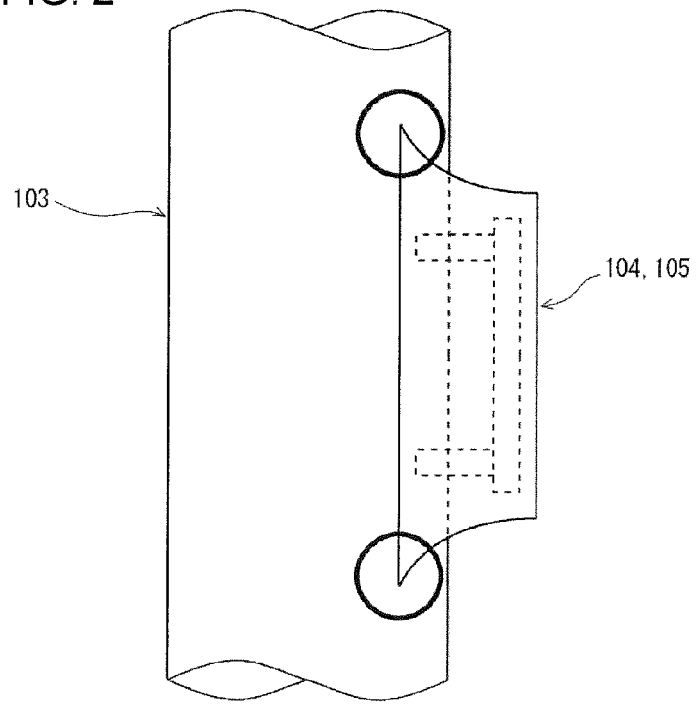
FIG. 2 is an enlarged plan view showing a region where a mounting bracket is located in a cross frame of a conventional bogie frame.

As described above, the mounting bracket support portions 34 and 35, which serve as the upper surface portions and the lower surface portions of the mounting brackets 4 and 5, are formed integrally with the cross frame top plate member 31 and the cross frame bottom plate member 32, i.e., integrally with the cross frame 3, and the mounting brackets 4 and 5 are welded to their respective mounting bracket support portions 34 and 35. As a result of this, fillet weld toes, such as those that exist at the weld zones between the mounting brackets 104 and 105 and the cross frame 103 in the conventional bogie frame 101 (see FIG. 2), do not exist, and therefore man-hours required for treatments can be saved. Moreover, the rib-structured mounting brackets 4 and 5 are welded to the cross frame 3, which has a four-plate structure, rather than a steel pipe such as the steel pipe 103 in the conventional bogie frame 101, and therefore the number of weld zones having short weld lines is reduced.

Consequently, the bogie frame 1 for railway vehicles of the present invention is capable of being provided with reduced weld zones having short weld lines and also with reduced fillet weld toes that need to be treated when the mounting brackets 4 and 5 are welded to the cross frame 3. As a result, it is possible to improve the efficiency of the work of welding while ensuring the quality of the weld zones, thus making it possible to achieve good welding workability for assembling.

It is to be noted that, since the mounting brackets 4 and 5 are subjected to high loads during travel of the railway vehicle, stress concentration is more likely to occur at root regions of the mounting bracket support portions 34 and 35 that extend from the cross frame top plate member 31 and the cross frame bottom plate member 32. In particular, stress is concentrated at each corner region where one of the left and right edges of the mounting bracket support portions 34 and 35 meets its corresponding one of the front and rear edges of the cross frame top plate member 31 and the cross frame bottom plate member 32. If weld beads, which join the cross frame top plate member 31 and the cross frame bottom plate member 32 to the cross frame side plate members 33, overlap onto or are located close to the corner regions where stresses are concentrated, the fatigue limit stress of the corner regions decreases and therefore the safety factor in the regions may decrease. Because of this, it is desired that suitable configurations be adopted so as to increase the safety factor in the mounting bracket support portions 34 and 35. Illustrative configurations for that are described below.

Figure 5:
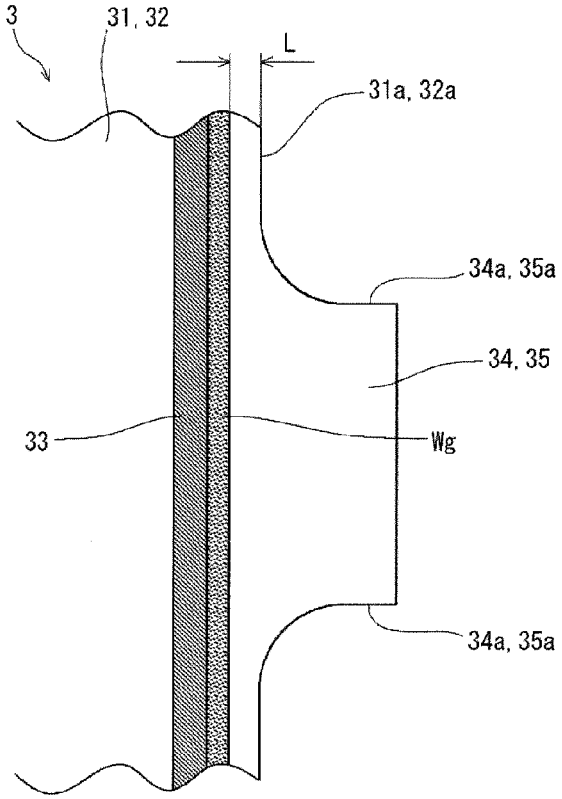
FIG. 5 is an enlarged sectional view of a region where a mounting bracket support portion is located, showing an example of the configurations for increasing the safety factor in the mounting bracket support portions of the cross frame of the bogie frame according to the present invention.

FIG. 5 is an enlarged sectional view of a region where a mounting bracket support portion is located, showing an example of the configurations for increasing the safety factor in the mounting bracket support portions of the cross frame of the bogie frame according to the present invention. As shown in FIG. 5, the length L is defined as one from each of the front and rear edges 31*a* and 32*a* of the cross frame top plate member 31 and the cross frame bottom plate member 32 to its corresponding weld bead Wg which joins these plate members 31 and 32 and the cross frame side plate members 33 together, and the front and rear edge portions of the cross frame top plate member 31 and the cross frame bottom plate member 32 are made to protrude relative to the boundaries of the weld beads Wg.

In this case, if the length L is set to be longer, each corner region where stress is concentrated, i.e., each corner region, where one of the left and right edges 34*a* and 35*a* of the mounting bracket support portions 34 and 35 meets its corresponding one of the front and rear edges 31*a* and 32*a* of the cross frame top plate member 31 and the cross frame bottom plate member 32, becomes farther away from its corresponding weld bead, and in association with this, the fatigue limit stress of the corner regions approaches the nominal stress, and therefore it is possible to increase the safety factor in the mounting bracket support portions 34 and 35. Preferably, the length L may be as long as possible if it is allowed in relation to the arrangement of various components that constitute the bogie. It is noted that the corner regions described above are round-chamfered.

Figure 6:
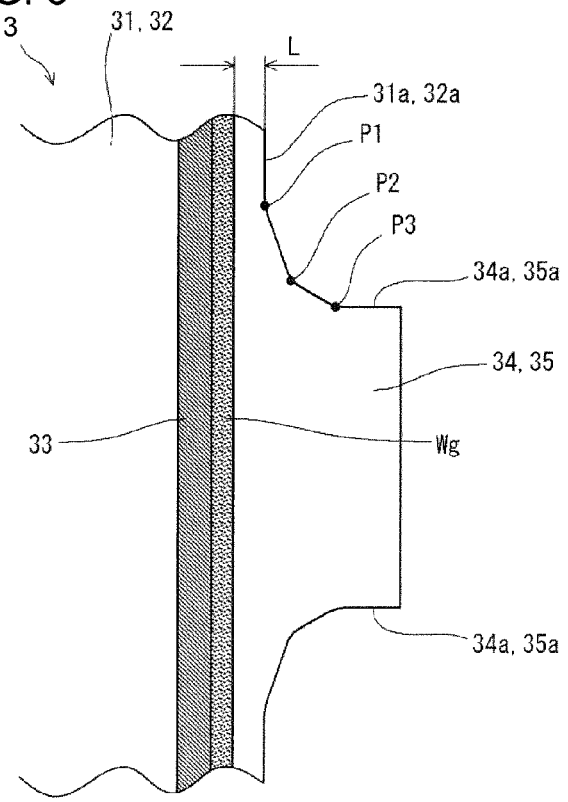
FIG. 6 is an enlarged sectional view of a region where a mounting bracket support portion is located, showing another example of the configurations for increasing the safety factor in the mounting bracket support portions of the cross frame of the bogie frame according to the present invention.

FIG. 6 is an enlarged sectional view of a region where a mounting bracket support portion is located, showing another example of the configurations for increasing the safety factor in the mounting bracket support portions of the cross frame of the bogie frame according to the present invention. As shown in FIG. 6, it is preferred that the cross frame has a contoured shape such that a flared portion which is bent at least three points is provided between each of the left and right edges 34*a* and 35*a* of the mounting bracket support portions 34 and 35 and its corresponding one of the front and rear edges 31*a* and 32*a* of the cross frame top plate member 31 and the cross frame bottom plate member 32 wherein the bend points are designated P1, P2, and P3 starting from the point closest to the edges 31*a* and 32*a* of the cross frame top plate member 31 and the cross frame bottom plate member 32. The three bend points are all round-chamfered.

When such contoured shape including flared portions bent at three points as described above is employed, stress concentration is distributed particularly between the two points (P1, P2) that are closer to the edges 31*a* and 32*a* of the cross frame top plate member 31 and the cross frame bottom plate member 32. In association with this, the fatigue limit stress of these points approaches the nominal stress, and therefore it is possible to increase the safety factor in the mounting bracket support portions 34 and 35. It is to be noted that the same effects are produced as long as there are three or more bend points.

EXAMPLES

To verify the advantages of the bogie frame according to the present invention, the following evaluations were made.

[Welding Workability]

Figure 1:
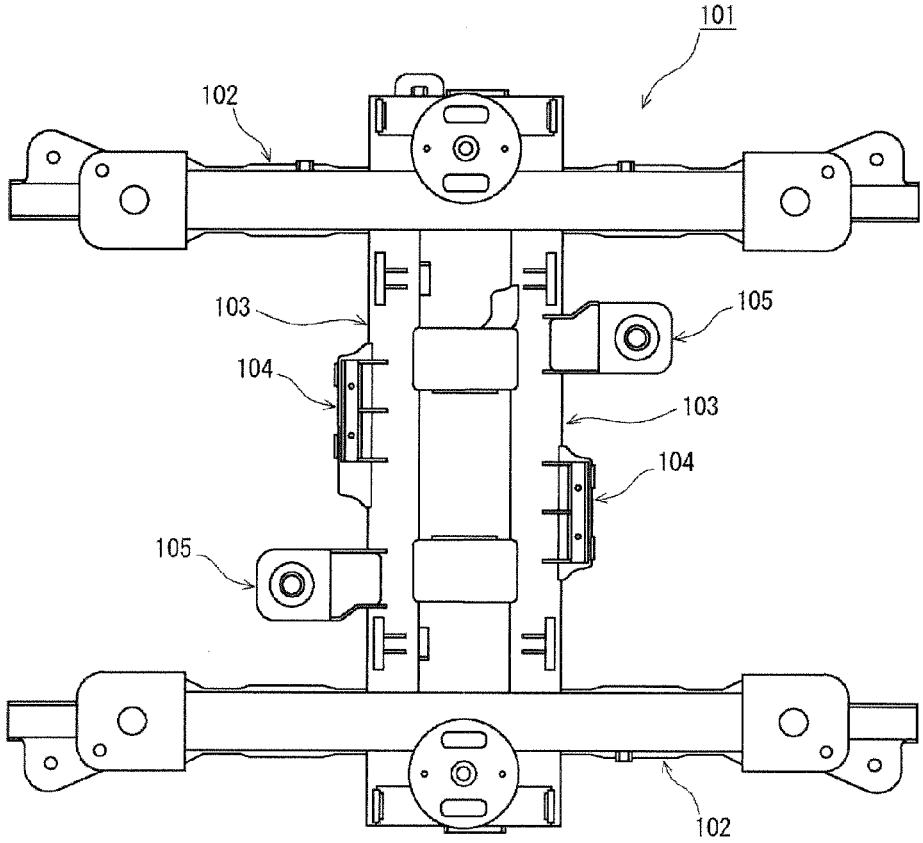
FIG. 1 is a plan view of a conventional bogie frame.

Investigations were made on the bogie frame of the present invention shown in FIG. 3 and the conventional bogie frame shown in FIG. 1 in such a manner that a mounting bracket for a traction motor and a mounting bracket for a gearbox were welded to the cross frame of each of them and the number of weld zones having short weld lines, exclusively in the weld zones of the mounting brackets, was determined. As the weld zones having short weld lines, those having a length of 99 mm or less were extracted.

The results of the investigations show that the conventional bogie frame had 74 weld zones having short weld lines, whereas the bogie frame of the present invention had 12 such weld zones, which is a significantly low number. This result demonstrates that the bogie frame of the present invention is capable of being provided with reduced weld zones having short weld lines when the mounting brackets are welded to the cross frame, and thus being provided with ensured quality of the weld zones.

[Stress Safety Factor for Mounting Brackets]

Regarding the bogie frame of the present invention shown in FIG. 3, an investigation was made on the stress safety factor in the mounting bracket support portion, which extends from the cross frame having a joined-four-plate structure and serves as the upper surface portion of the mounting bracket for a traction motor. Also, for comparison, an investigation was made, regarding the conventional bogie frame shown in FIG. 1, on the stress safety factor in the upper surface portion of the mounting bracket for a traction motor welded to the cross frame which is formed of a steel pipe. Specifically, a static load test was conducted in which a vertical load of the traction motor was applied to the mounting bracket. In the test, for the bogie frame of the present invention, the stress acting on the mounting bracket support portion was measured, and for the conventional bogie frame, the stress acting on the upper surface portion of the mounting bracket was measured, and the safety factors were calculated from these stresses. The fatigue limit of the weld zones was determined using the method according to JIS-E-4207 (Japanese Industrial Standards).

The results of the investigations show that the conventional bogie frame had a safety factor of as small as 1.5, whereas the bogie frame of the present invention had a large safety factor at 1.9. These results demonstrate that the bogie frame of the present invention is capable of being provided with an increased stress safety factor for the mounting brackets.

The present invention is not limited to the embodiments described above, and various modifications may be made without departing from the spirit and scope of the present invention. For example, in the above-described embodiment, when joining together the cross frame and the side frames, each having a joined-four-plate structure, the end edges of the cross frame top plate member and the cross frame bottom plate member are butt welded to the end edges of their respective corresponding connecting portions of the side frames in such a manner that they are flush with each other. Alternatively, the joining may be accomplished by placing the end edge portions of the cross frame top plate member and the cross frame bottom plate member on the back sides of the end edge portions of their respective corresponding connecting portions of the side frames directly or via a backing metal, and joining these together by fillet welding. In addition, in order to ensure stiffness of the cross frame and the side frames, each having a joined-four-plate structure, the cross frame and the side frames may each include a reinforcing plate welded to the inside thereof.

INDUSTRIAL APPLICABILITY

The bogie frame for railway vehicles of the present invention is useful in a variety of railway vehicle applications.

REFERENCE SIGNS LIST

1: bogie frame,
2: side frame,
3: cross frame,
4: mounting bracket for traction motor,
5: mounting bracket for gearbox,
6: spring cover member,
21: side frame top plate member,
22: side frame bottom plate member,
23: side frame side plate member,
24: connecting portion,
31: cross frame top plate member,
31*a*: front and rear edges of cross frame top plate member,
32: cross frame bottom plate member,
32*a*: front and rear edges of cross frame bottom plate member,
33: cross frame side plate member,
34: mounting bracket for traction motor support portion,
34*a*: left and right edges of mounting bracket for traction motor support portion,
35: mounting bracket for gearbox support portion,
35*a*: left and right edges of mounting bracket for gearbox support portion,
Wg: weld bead

What is claimed is:

1. A bogie frame for railway vehicles, comprising:

a pair of left and right side frames disposed along a direction of rails; and a cross frame that connects the side frames to each other, the cross frame comprising a top plate member, a bottom plate member, and a pair of front and rear side plate members that are disposed between the top plate member and the bottom plate member and welded to the top plate member and the bottom plate member, wherein the cross frame has mounting bracket support portions that extend from front and rear edges of the top plate member and the bottom plate member, the mounting bracket support portions being located correspondingly to locations where mounting brackets for mounting a traction motor and mounting brackets for mounting a gearbox are disposed, and the mounting brackets are welded to the mounting bracket support portions.

2. The bogie frame for railway vehicles according to claim 1, wherein the cross frame has a contoured shape such that a flared portion which is bent at least three points is provided between each of the left and right edges of the mounting bracket support portions and a corresponding one of the front and rear edges of the top plate member and the bottom plate member.

3. The bogie frame for railway vehicles according to claim 2, wherein the side frame comprises a side frame top plate member, a side frame bottom plate member, and a pair of left and right side frame side plate members that are disposed between the side frame top plate member and the side frame bottom plate member and welded thereto, and wherein each of the side frames has a connecting portion that extends from one of left and right edges of the side frame top plate member thereof and a corresponding connecting portion that extends from a corresponding edge of the side frame bottom plate member thereof, the connecting portions being located correspondingly to a location where the cross frame is disposed, and left and right end portions of the cross frame are fitted between the connecting portions and welded thereto.

4. The bogie frame for railway vehicles according to claim 3, wherein the connecting portion is integrally formed with the side frame top plate member and the side frame bottom plate member.

5. The bogie frame for railway vehicles according to claim 1, wherein the side frame comprises a side frame top plate member, a side frame bottom plate member, and a pair of left and right side frame side plate members that are disposed between the side frame top plate member and the side frame bottom plate member and welded thereto, and wherein each of the side frames has a connecting portion that extends from one of left and right edges of the side frame top plate member thereof and a corresponding connecting portion that extends from a corresponding edge of the side frame bottom plate member thereof, the connecting portions being located correspondingly to a location where the cross frame is disposed, and left and right end portions of the cross frame are fitted between the connecting portions and welded thereto.

6. The bogie frame for railway vehicles according to claim 5, wherein the connecting portion is integrally formed with the side frame top plate member and the side frame bottom plate member.

7. The bogie frame for railway vehicles according to claim 1, wherein the mounting bracket supporting portion is integrally formed with the top plate member of the cross frame and the bottom plate member of the cross frame.

* * * * *